US011892011B2

(12) United States Patent
Pan

(10) Patent No.: US 11,892,011 B2
(45) Date of Patent: Feb. 6, 2024

(54) FAN

(71) Applicant: Lenovo (Beijing) Limited, Beijing (CN)

(72) Inventor: Bo-Fu Pan, Beijing (CN)

(73) Assignee: Lenovo (Beijing) Limited, Beijing (CN)

( * ) Notice: Subject to any disclaimer, the term of this patent is extended or adjusted under 35 U.S.C. 154(b) by 0 days.

(21) Appl. No.: 17/954,816

(22) Filed: Sep. 28, 2022

(65) Prior Publication Data

US 2023/0213041 A1 Jul. 6, 2023

(30) Foreign Application Priority Data

Dec. 31, 2021 (CN) ..... 202111666066.0

(51) Int. Cl.
*F04D 29/42* (2006.01)
*F04D 17/16* (2006.01)

(52) U.S. Cl.
CPC ..... *F04D 29/4226* (2013.01); *F04D 17/16* (2013.01)

(58) Field of Classification Search
CPC ..... F04D 29/4226
See application file for complete search history.

(56) References Cited

U.S. PATENT DOCUMENTS

| | | | | |
|---|---|---|---|---|
| 2006/0024160 | A1 | 2/2006 | Horng et al. | |
| 2015/0139833 | A1 | 5/2015 | He et al. | |
| 2016/0146216 | A1* | 5/2016 | Chang | F04D 29/4226 415/203 |
| 2019/0285075 | A1* | 9/2019 | Chang | F04D 29/422 |

FOREIGN PATENT DOCUMENTS

| | | | |
|---|---|---|---|
| CN | 203770218 | U | 8/2014 |
| CN | 106292944 | A | 1/2017 |
| CN | 111006316 | A | 4/2020 |
| KR | 20030072947 | A | 9/2003 |

* cited by examiner

*Primary Examiner* — Sabbir Hasan
(74) *Attorney, Agent, or Firm* — ANOVA LAW GROUP, PLLC

(57) ABSTRACT

A fan includes a housing, a rotation body, and an auxiliary inlet. The housing includes an accommodation chamber, an air inlet, and an air outlet. The rotation body is arranged in the accommodation chamber, forms a guide channel with an inner wall of the accommodation chamber, and is configured to drive air to enter from the air inlet and be guided out from the air outlet through the guide channel. The auxiliary inlet is arranged on the guide channel and configured to introduce the air into the guide channel.

6 Claims, 7 Drawing Sheets

FAN

CROSS-REFERENCE TO RELATED APPLICATION

This application claims priority to Chinese Patent Application No. 202111666066.0, filed on Dec. 31, 2021, the entire content of which is incorporated herein by reference.

TECHNICAL FIELD

The present disclosure relates to a fan.

BACKGROUND

A fan is a commonly used device. However, the current fan has limited types and poor adaptability.

SUMMARY

Embodiments of the present disclosure provide a fan, including a housing, a rotation body, and an auxiliary inlet. The housing includes an accommodation chamber, an air inlet, and an air outlet. The rotation body is arranged in the accommodation chamber, forms a guide channel with an inner wall of the accommodation chamber, and is configured to drive air to enter from the air inlet and be guided out from the air outlet through the guide channel. The auxiliary inlet is arranged on the guide channel and configured to introduce the air into the guide channel.

The fan of embodiments of the present disclosure includes the housing, the air inlet, and the air outlet. The housing includes an accommodation chamber. The rotation body is arranged in the accommodation chamber, forms the guide channel with the inner wall of the accommodation chamber, and is configured to drive the air to enter from the air inlet and be guided out from the air outlet through the guide channel. The housing also includes at least one auxiliary inlet. The auxiliary inlet is arranged on the guide channel. The auxiliary inlet is configured to introduce the air into the guide channel. With the fan of embodiments of the present disclosure, the amount of air entering the guide channel may be increased by the auxiliary inlet.

Figure 1:
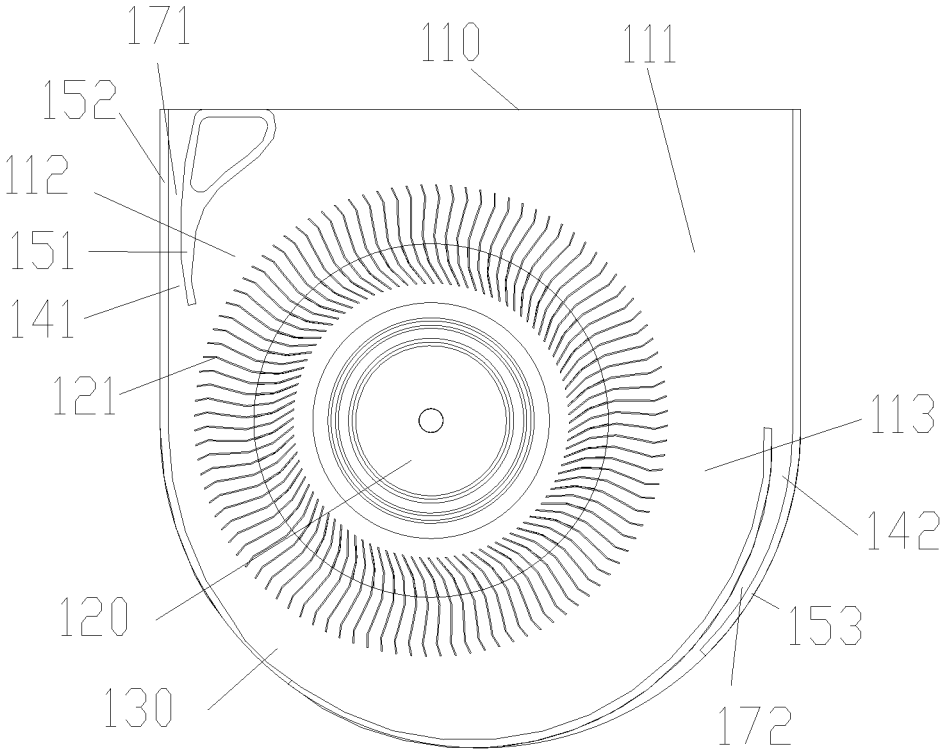
FIG. 1 illustrates a schematic structural cross-section diagram of a fan according to embodiments of the present disclosure.

Reference numerals:

| | | |
|---|---|---|
| 100 Housing; | 111 Accommodation chamber; | 112 Air inlet; |
| 113 Air outlet; | 114 First half housing | 115 Second half housing; |
| 120 Rotation body; | 121 Fan blade; | 130 Guide channel; |
| 140 Auxiliary inlet opening; | 141 First auxiliary inlet opening; | |
| 142 Second auxiliary inlet; | 143 Third auxiliary inlet; | 151 First wall; |
| 152 Second wall; | 153 Third wall; | 161 First rotation shaft; |
| 162 Second rotation shaft; | 171 First channel; | 172 Second channel; |
| 173 Third channel. | | |

DETAILED DESCRIPTION OF THE EMBODIMENTS

The technical solutions of the present disclosure are further described below with reference to the accompanying drawings and specific embodiments of the present disclosure.

In the description of embodiments of the present disclosure, unless otherwise specified and limited, the term "connection" should be understood in a broad sense. For example, the "connection" may be an electrical connection, internal communication between two components, or a direct connection, and may also be an indirect connection through an intermediate medium. For those of ordinary skill in the art, specific meanings of the above term can be understood according to specific situations.

The term "first\second\third" involved in embodiments of the present disclosure is only used to distinguish similar objects and does not represent a specific order of the objects. For the "first\second\third," a specific order or sequence may be interchanged where permitted. The objects distinguished by "first\second\third" may be interchanged under an appropriate circumstance. Thus, embodiments of the present disclosure described here may be practiced in a sequence other than a sequence illustrated or described here.

A fan of embodiments of the present disclosure is described in detail below with reference to FIGS. 1 to 7.

The fan includes a housing 110 and a rotation body 120. The housing 110 includes an accommodation chamber 111, an air inlet 112, and an air outlet 113. The rotation body 120 is arranged in the accommodation chamber 111. The rotation body 120 and an inner wall of the accommodation chamber 111 form a guide channel 130. The rotation body 120 may be configured to drive air to enter from the air inlet 112 and to be guided out from the air outlet 113 through the guide channel 130. The housing 110 further includes at least an auxiliary inlet 140. The auxiliary inlet 140 is located on the guide channel 130. The auxiliary inlet 140 may be configured to introduce the air into the guide channel 130. Thus, the air amount introduced into the guide channel 130 may be increased with the guide channel 130.

Figure 5:
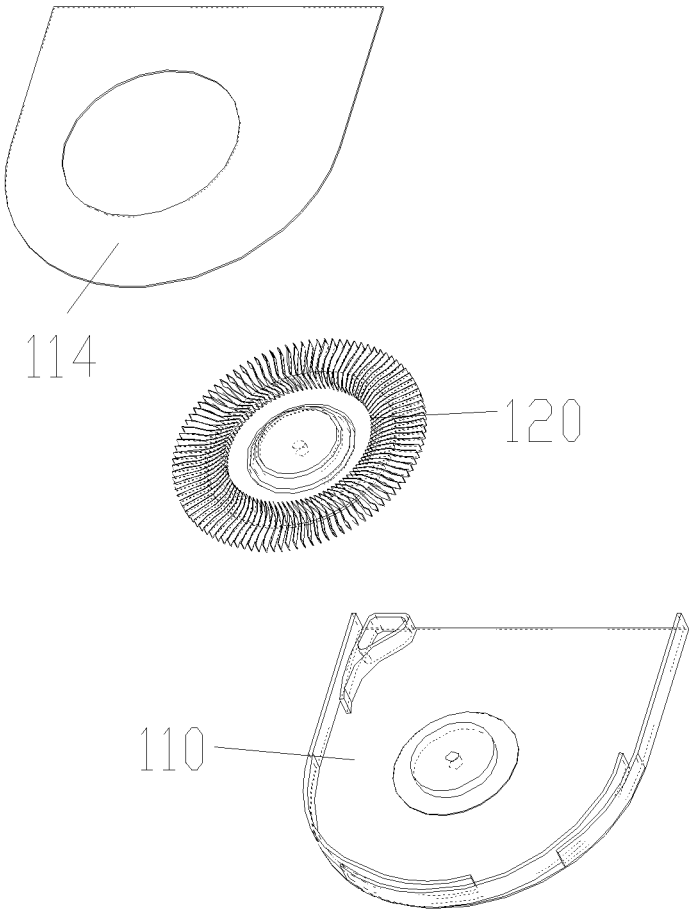
FIG. 5 illustrates a schematic exploded structural diagram of a fan according to embodiments of the present disclosure.

In embodiments of the present disclosure, the structure of the housing 110 is not limited. For example, a cross-section of the housing 110 may have a circular shape or may have a shape similar to the circular shape. For example, as shown in FIG. 5, the housing 110 includes a first half housing 114 and a second half housing 115. The first half housing 114 and the second half housing 115 may be detachably connected. Thus, the rotation body 120 may be easily placed into the accommodation chamber 111.

The shape of the accommodation chamber 111 is not limited. For example, the cross-section of the accommodation chamber 111 may have a circular shape or may have a shape similar to the circular shape.

The air inlet 112 and the air outlet 113 may be located on opposite sides of the rotation body 120.

In embodiments of the present disclosure, the structure of the rotation body 120 is not limited. For example, the rotation body 120 may include a fan blade 121. The fan blade 121 may be located on a peripheral side of the rotation body 120. The fan blade 121 may be configured to push the air to flow in the guide channel 130.

The rotation body 120 may be rotatably arranged in the accommodation chamber 111. The rotation body 120 and the inner wall of the accommodation chamber 111 may form the guide channel 130. The rotation body 120 may rotate to drive the air to enter from the air inlet 112 and be guided out from the air outlet 113 through the guide channel 130. The pressure may be increased after the air is pushed by the rotation body 120.

In embodiments of the present disclosure, the structure of the auxiliary inlet 140 is not limited.

For example, the auxiliary inlet 140 may be an opening formed on the inner wall of the accommodation chamber 111. The opening may be communicated with the guide channel 130.

For another example, the housing 110 may further include a channel communicated with the auxiliary inlet 140. The channel may be configured to provide a guidance function for the air flowing through the auxiliary inlet 140.

In some embodiments, the direction of the channel is not limited. For example, a setting direction of the channel and a tangent of an end of the fan blade 121 may satisfy a parallel condition. Thus, the air can be introduced along a tangential direction of the end of the fan blade 121 through the channel. Therefore, an air inlet amount along the tangential direction of the end of the fan blade 121 may be increased.

In some embodiments, an external dimension of the fan and an external dimension of the rotation body 120 may be fixed. Since the cross-sectional area of the guide channel 130 at a position of the channel where the auxiliary inlet 140 is arranged is reduced, the air pressure of the guide channel 130 may be increased with the speed of the rotation body 120 unchanged. Further, the pressure for pushing the air at the end of the fan blade 121 may be increased, and the ability of the fan blade 121 to push the air may be increased. In addition, since the air pressure of the guide channel 130 is increased, the flow rate of the air in the guide channel 130 may be also increased. The flow rate of the air pushed by the end of the fan blade 121 may be also increased. Thus, the pressure, flow rate, and flow amount of the air guided out by the fan may be greatly increased.

In some embodiments, the parallel condition may indicate parallel or substantially parallel.

The auxiliary inlet 140 may be arranged on the guide channel 130. The auxiliary inlet 140 may be configured to introduce the air into the guide channel 130. Thus, the air amount entering the guide channel 130 may be increased through the auxiliary inlet 140.

Figure 2:
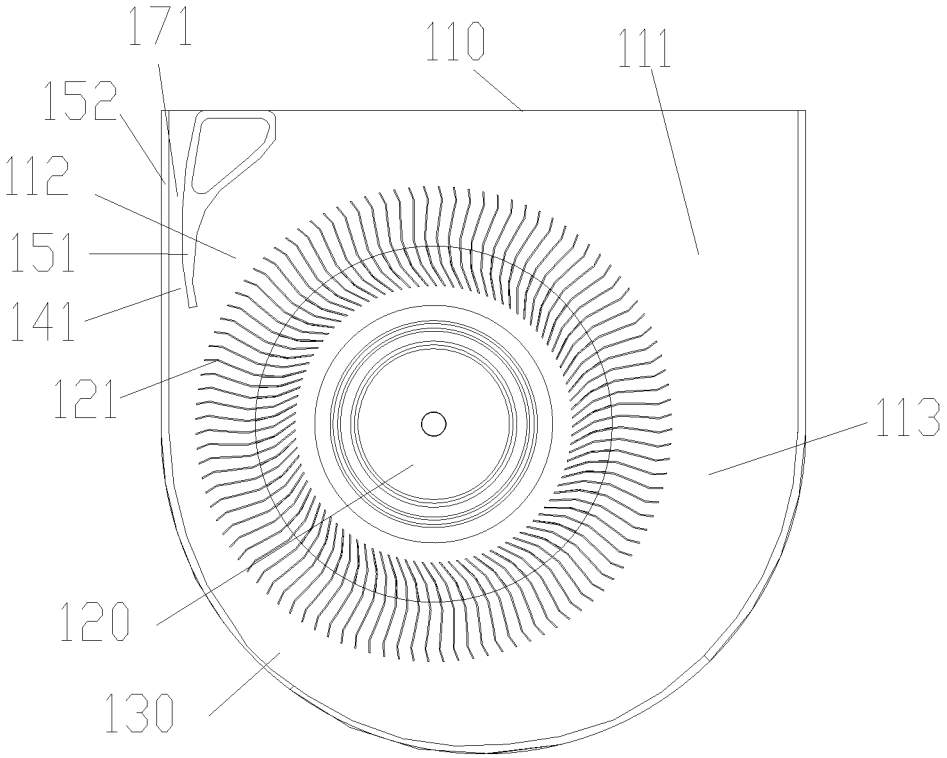
FIG. 2 illustrates a schematic structural cross-section diagram of a fan according to embodiments of the present disclosure.
Figure 3:
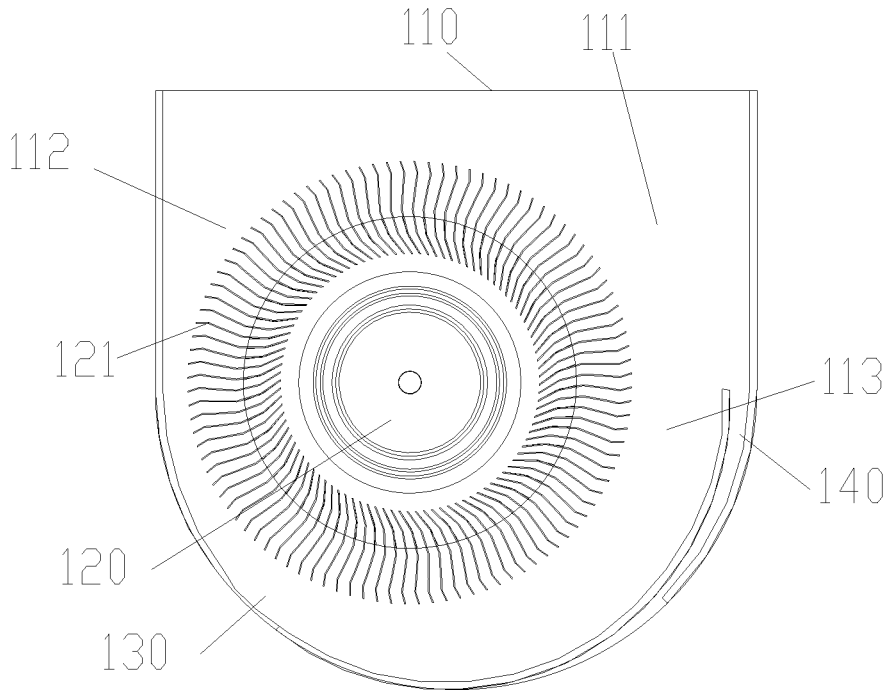
FIG. 3 illustrates a schematic structural cross-section diagram of a fan according to embodiments of the present disclosure.
Figure 4:
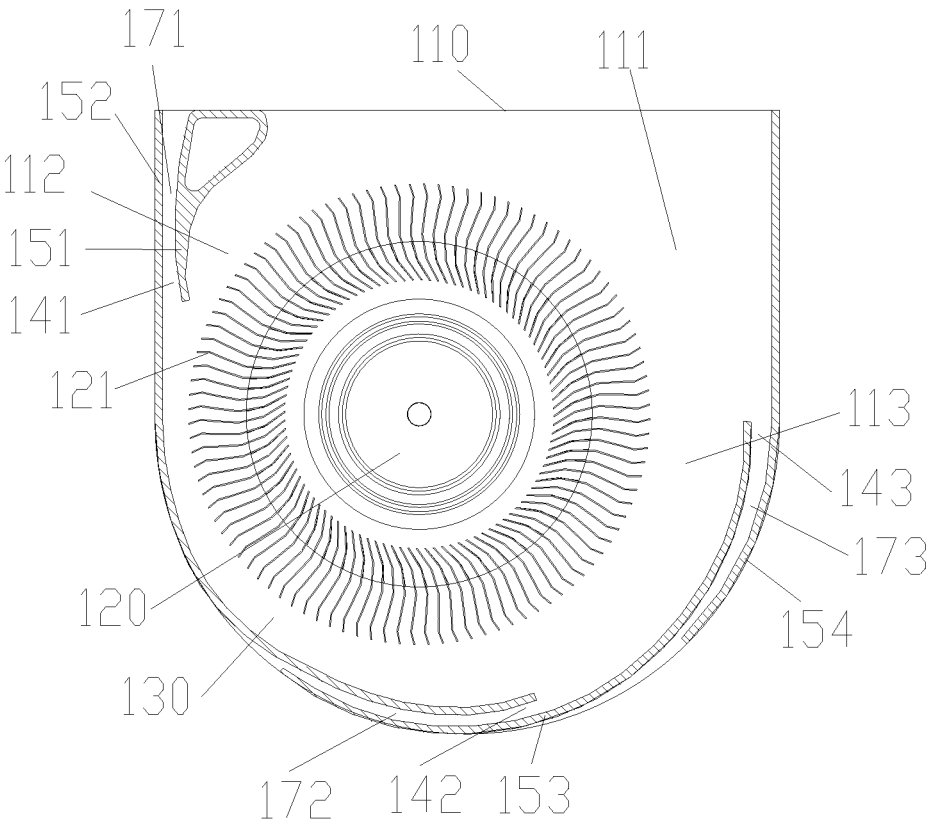
FIG. 4 illustrates a schematic structural cross-section diagram of a fan according to embodiments of the present disclosure.

A number of auxiliary inlets 140 is not limited. For example, as shown in FIGS. 2 and 3, one auxiliary inlet 140 is provided. For another example, as shown in FIG. 1, two auxiliary inlets 140 are provided. For another example, as shown in FIG. 4, three auxiliary inlets 140 are provided.

An arrangement position of the auxiliary inlet 140 is not limited. For example, as shown in FIG. 1 and FIG. 2, the auxiliary inlet 140 is arranged on a side close to the air inlet 112. When the housing 110 further includes a channel communicated with the auxiliary inlet 140, the pressure of the guide channel 130 may be increased at the air inlet 112. Thus, an extrusion area of the guide channel 130 may be increased, a pressure release area may be reduced, and an ability of the fan may be increased to increase the pressure. For another example, as shown in FIG. 1 and FIG. 3, the auxiliary inlet 140 is arranged on a side close to the air outlet 113. When the housing 110 further includes a channel communicated with the auxiliary inlet 140, the pressure of the guide channel 130 may be increased at the air outlet 113. Thus, the pressure and flow rate of the air guided out from the fan may be increased. For another example, as shown in FIG. 4, the auxiliary inlet 140 is arranged at a middle member of the guide channel 130. When the housing 110 further includes a channel communicated with the auxiliary inlet 140, the pressure and flow rate in the middle position of the guide channel 130 may be increased.

In embodiments of the present disclosure, the housing 110 may include at least two walls. The auxiliary inlet 140 may be formed between a first end of one wall of the at least two walls and the other wall of the at least two walls. The channel communicated with the auxiliary inlet 140 may be formed between one wall of the at least two walls and the other wall of the at least two walls. Thus, the channel between the two walls may be configured to provide a guidance function for the air entering the auxiliary inlet 140.

In some embodiments, an arrangement direction of the at least two walls may be substantially the same as an arrangement direction of the inner wall of the accommodation chamber 111. Thus, the direction of the channel between the two walls may be substantially consistent with the direction of the guide channel 130. Thus, a flow direction of the air entering the guide channel 130 from the auxiliary inlet 140 may be substantially consistent with a flow direction of the air originally flows in the guide channel 130, which prevents the air entering the guide channel 130 from the auxiliary inlet 140 from impacting the flow of the air originally flowing in the guide channel 130.

In some embodiments, the auxiliary inlet 140 may be configured to increase the pressure of the air at the end of the fan blade 121. The external dimension of the fan may be fixed, and the dimension of the rotation body 120 may be fixed. Since the auxiliary inlet 140 and the channel are formed by the at least two walls, cross-section areas of the positions corresponding to the guide channel 130 and the auxiliary inlet 140 may become smaller. Thus, if the rotation speed of the rotation body 120 is the same, the air pressure of the positions corresponding to the guide channel 130 and the auxiliary inlet 140 may be increased. The pressure of the air at the end of the fan blade 121 may also be increased. The ability of the fan blade may be increased to push the air. Meanwhile, with the large pressure, more air may enter the guide channel 130 from the auxiliary inlet 140. With a cooperated function of the large pressure and the auxiliary inlet 140, the fan may drive more air to flow in the guide channel 130 with the same power, which greatly increases the ability of the fan to drive the air.

In some embodiments, as shown in FIGS. 1 and 2, the housing 110 includes a first wall 151 and a second wall 152. The first wall 151 is arranged on a side close to the air inlet 112. A first end of the first wall 151 and the rotation body 120 form the air inlet 112. The second wall 152 is arranged on a side of the first wall 151 away from the rotation body 120. A first part of the second wall 152 and the first end of the first wall 151 form a first auxiliary inlet 141 and a first channel 171. A second part of the second wall 152 and the rotation body 120 form at least a part of the guide channel 130. The first end of the first wall 151 may be an end of the first wall 151 close to the air outlet 113. Thus, the air inlet amount at the air inlet 112 may be increased through the first auxiliary inlet 141.

The shapes of the first wall 151 and the second wall 152 are not limited. For example, the first wall 151 and the second wall 152 may include curved wall members. Thus, the first wall 151 and the second wall 152 may form a curved guide channel 130 with the rotation body 120.

In some embodiments, the housing 110 may further include a third wall 153. A first end of the third wall 153 may be arranged on a side of a second end of the second wall 152 away from the rotation body 120. The first end of the third wall 153 and the second end of the second wall 152 may form a second auxiliary inlet 142 and a second channel 172.

As shown in FIG. 4, the second auxiliary inlet 142 is arranged in the middle of the guide channel 130. As shown in FIG. 1, the second auxiliary inlet 142 is also arranged at the air outlet 113. The shape of the third wall 153 is not limited. For example, the third wall 153 may include a curved wall member. Thus, the third wall 153 and the rotation body 120 may form the curved guide channel 130.

Figure 6:
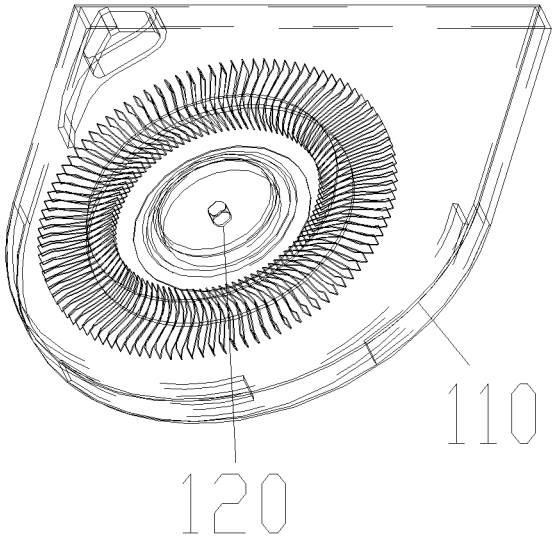
FIG. 6 illustrates a schematic structural diagram of a fan according to embodiments of the present disclosure.

In some embodiments, as shown in FIG. 4 and FIG. 6, the housing 110 further includes the third wall 153 and a fourth wall. The first end of the third wall 153 is located on the side of the second end of the second wall 152 away from the rotation body 120. The first end of the third wall 153 and the second end of the second wall 152 may form the second auxiliary inlet 142 and the second channel 172. The second end of the third wall 153 and the rotation body 120 may form the air outlet 113. The first end of the fourth wall may be arranged on the side of the second end of the third wall 153 away from the rotation body 120. The first end of the fourth wall and the second end of the third wall 153 may form a third auxiliary inlet 143 and a third channel 173. Thus, the pressure, flow rate, and flow amount of the air entering the guide channel 130 may be increased at different positions of the guide channel 130 through the three auxiliary inlets 140.

The middle member of the second wall 152 and the rotation body 120 may form a part of the guide channel 130. The middle member of the third wall 153 and the rotation body 120 may form a part of the guide channel 130. Thus, by staggering the first wall 151, the second wall 152, and the third wall 153, the guide channel 130, the auxiliary inlet 140, and the channel may be formed. Meanwhile, since the first wall 151, the second wall 152, and the third wall 153 are staggered with each other, the support strength of the housing 110 may also be improved by double-layered walls by staggering the first wall 151, the second wall 152, and the third wall 153.

The shape of the fourth wall is not limited. For example, the fourth wall may include a curved wall member. Thus, the fourth wall may form the curved guide channel 130 with the rotation body 120.

For example, the first wall 151, the second wall 152, the third wall 153, and the fourth wall each may include a curved wall member. Thus, by staggering the first wall 151, the second wall 152, the third wall 153, and the fourth wall, the guide channel 130 may be formed, a plurality of auxiliary inlets 140 may be formed, and the air inlet amount and the air guide pressure of the fan may be increased. Since the first wall 151, the second wall 152, the third wall 153, and the fourth wall are staggered, the support strength of the housing 110 may be greatly improved by the staggered double-layered walls.

In some embodiments, the other wall of the at least two walls may move relative to the rotation body 120 to adjust the size of the auxiliary inlet 140. Thus, the size of the auxiliary inlet 140 may be adjusted through the movement of the other wall of the at least two walls to further adjust the air amount entering the guide channel 130 through the auxiliary inlet 140.

An implementation of the movement of the other wall of the at least two walls is not limited. For example, the other wall of the at least two walls may be rotatably arranged through a rotation shaft. The other wall of the at least two walls may rotate about the rotation shaft.

Figure 7:
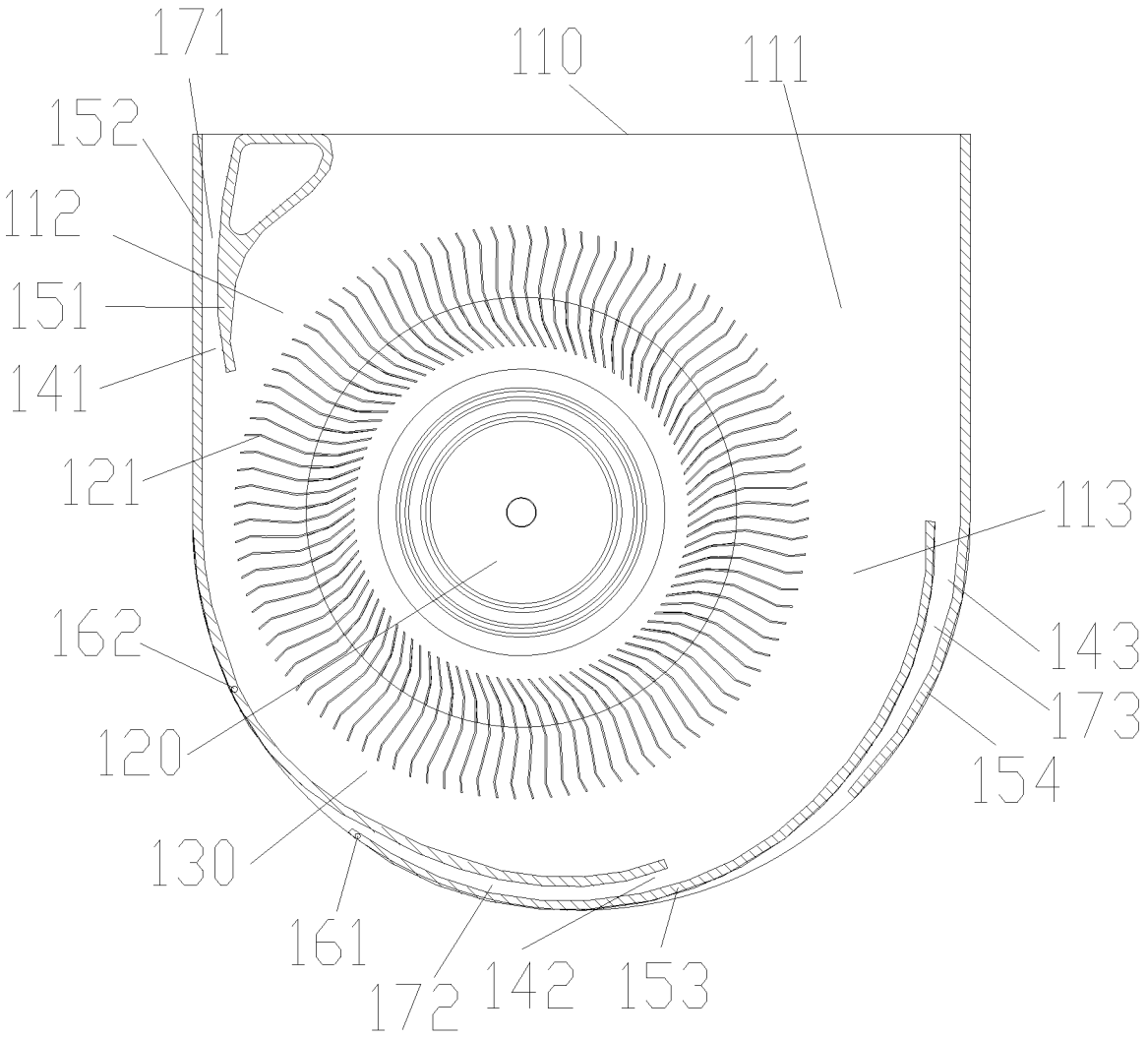
FIG. 7 illustrates a schematic structural cross-section diagram of a fan according to embodiments of the present disclosure.

The position where the rotation shaft is arranged is not limited. For example, as shown in FIG. 7, the first end of the third wall 153 is rotatably connected to the housing 110 through the first rotation shaft 161. For another example, as shown in FIG. 7, the middle member of the second wall 152 is rotatably connected to the housing 110 through the second rotation shaft 162.

A control manner of the movement of the other wall of the at least two walls relative to the rotation body 120 is not limited. For example, when the air inlet amount or pressure of the fan needs to be increased, the other wall of the at least two walls may be controlled to move relative to the rotation body 120 to increase the auxiliary inlet 140. When the air inlet amount of the fan needs to be reduced, the other wall of the at least two walls may be controlled to move relative to the rotation body 120 to reduce the size of the auxiliary inlet 140.

Those skilled in the art can also adjust the sizes of the auxiliary inlets 140 at different positions and the air inlet amount at different positions of the guide channel 130 as needed.

The fan of embodiments of the present disclosure may include the housing 110 and the rotation body 120. The housing 110 may include the accommodation chamber 111, the air inlet 112, and the air outlet 113. The rotation body 120 may be arranged in the accommodation chamber 111. The rotation body 120 may form the guide channel 130 with the inner wall of the housing 110 of the accommodation chamber 111 and be configured to drive the air to enter from the air inlet 112 and be guided out from the air outlet 113 through the guide channel 130. The housing 110 may further include at least one auxiliary inlet 140. The auxiliary inlet 140 may be arranged on the guide channel 130. The auxiliary inlet 140 may be configured to introduce the air into the guide channel 130. Thus, the amount of air entering the guide channel 130 may be increased with the auxiliary inlet 140.

The above are only specific embodiments of the present disclosure. However, the scope of the present disclosure is not limited to this. Those skilled in the art should easily think of modifications and replacements within the scope of the present disclosure. These modifications and replacements should be within the scope of the present disclosure. Thus, the scope of the present application should be subjected to the scope of the appended claims. should be covered within the scope of protection of this application.

What is claimed is:

1. A fan comprising:

a housing including an accommodation chamber, an air inlet, and an air outlet;

a rotation body arranged in the accommodation chamber, forming a guide channel with an inner wall of the accommodation chamber, and configured to drive air to enter from the air inlet and be guided out from the air outlet through the guide channel; and at least one auxiliary inlet arranged on the guide channel and configured to introduce the air into the guide channel and to increase a pressure of the air at an end of a fan blade of the rotation body;

wherein the housing includes:

a first wall arranged on a side of the housing closer to the air inlet than to the air outlet, a first end of the first wall and the rotation body forming the air inlet, the first end of the first wall being an end of the first wall closer to the air outlet; and a second wall arranged on a side of the first wall away from the rotation body, a first auxiliary inlet of the at least one auxiliary inlet and a first channel, communicated to the first auxiliary inlet, of at least one channel being formed by a first member of the second wall and the first end of the first wall, a second member of the second wall and the rotation body forming at least a part of the guide channel;

a third wall, a first end of the third wall being located on a side of a second end of the second wall away from the rotation body, the first end of the third wall and the second end of the second wall forming a second auxiliary inlet of the at least one auxiliary inlet and a second channel, communicated to the second auxiliary inlet, of the at least one channel, and a second end of the third wall and the rotation body forming the air outlet; and a fourth wall, a first end of the fourth wall being located on a side of the second end of the third wall away from the rotation body, and the first end of the fourth wall and the second end of the third wall body forming a third auxiliary inlet of the at least one auxiliary inlet and a third channel, communicated to the third auxiliary inlet, of the at least one channel.

2. The fan according to claim 1, wherein:

the fan blade is arranged on a peripheral side of the rotation body and configured to push the air to flow in the guide channel; and each of the at least one channel being configured to provide a guidance function for the air flowing through a corresponding one of the at least one auxiliary inlet, and an arrangement direction of each of the at least one channel and a tangent of an end of the fan blade satisfying a parallel condition.

3. The fan according to claim 1, wherein each of the at least one auxiliary inlet is arranged on:

a side of the guide channel closer to the air inlet than to the air outlet;

a side of the guide channel closer to the air outlet than to the air inlet; or a middle member of the guide channel.

4. The fan according to claim 1, wherein:

a middle member of the second wall and the rotation body form a part of the guide channel; and a middle member of the third wall and the rotation body form another part of the guide channel.

5. The fan according to claim 1, wherein the first wall, the second wall, the third wall, and the fourth wall each include a curved wall member.

6. The fan according to claim 1, wherein:

the second wall moves relative to the rotation body to adjust a size of the first auxiliary inlet;

the second wall moves relative to the rotation body to adjust a size of the second auxiliary inlet; or the third wall moves relative to the rotation body to adjust a size of the third auxiliary inlet.

* * * * *